US006520785B2

(12) United States Patent
Hida

(10) Patent No.: US 6,520,785 B2
(45) Date of Patent: Feb. 18, 2003

(54) SWITCH-EQUIPPED COAXIAL CONNECTOR

(75) Inventor: Kohei Hida, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/908,634

(22) Filed: Jul. 20, 2001

(65) Prior Publication Data

US 2002/0025707 A1 Feb. 28, 2002

(30) Foreign Application Priority Data

Aug. 31, 2000 (JP) ..... 2000-263319

(51) Int. Cl.[7] ..... H01R 29/00
(52) U.S. Cl. ..... 439/188; 439/944; 200/51.09
(58) Field of Search ..... 439/188, 63, 944, 439/581; 200/51.09, 51.1

(56) References Cited

U.S. PATENT DOCUMENTS 6,030,240 A * 2/2000 Duff ..... 200/51.5
6,068,499 A * 5/2000 Kuriyama et al. ..... 439/188
6,099,334 A * 8/2000 Togashi ..... 439/188
6,142,803 A 11/2000 Bozzer
6,146,168 A * 11/2000 Ishii ..... 439/188
6,171,123 B1 * 1/2001 Chang ..... 439/188
6,224,407 B1 * 5/2001 Duquerroy et al. ..... 439/188

FOREIGN PATENT DOCUMENTS

JP 11-251001 9/1999

* cited by examiner

*Primary Examiner*—Hien Vu
(74) *Attorney, Agent, or Firm*—Kanesaka & Takeuchi

(57) ABSTRACT

A switch-equipped coaxial connector comprises an insulative housing (2) having a hollow section (14) and a bottom plate (15) between the hollow section (14) and the board, a fixed terminal (3) attached to the insulative housing (2) from side and having a contact section (25) provided within the hollow section (14), a movable terminal (4) attached to the insulative housing (2) from side and having a movable section (33) biased upwardly within the hollow section (14) to make contact with the contact section (25), a central conductor (5) for sliding in the axial direction of the insulative housing (2), a spring member (6) for supporting the central conductor (5), and an outer conductor (7) provided outside the spring member (6) and the insulative housing (2) such that when the central conductor (5) is depressed, the movable section (33) is separated from the contact section (25) of the fixed terminal (3).

7 Claims, 4 Drawing Sheets

SWITCH-EQUIPPED COAXIAL CONNECTOR

BACKGROUND OF THE INVENTION

1. Field of the Invention

The present invention relates to coaxial connectors to be mounted on a board and, particularly, to a coaxial connector equipped with a switch for making/breaking connections between respective terminals.

2. Description of the Related Art

A switch-equipped coaxial connector is widely used in a mobile phone provided in an automobile for switching between an inner antenna of the mobile phone and an outer antenna of the automobile. An example of such a switch-equipped coaxial connector is disclosed by Japanese patent application Kokai No. 11-251001. It comprises a central conductor for sliding in the axial direction and a pair of terminals attached to a recess provided in the housing on the mounting side such that the lower end of the central conductor is in contact with the spring section of one of the terminals. When the inner antenna is used, the spring section keeps the terminals contact. When the outer antenna is used, the spring section is depressed via the central conductor to break the contact between the terminals.

However, when the coaxial connector is mounted on a board, the gas or flux enters the coaxial connector through the area in which the switch is provided. In addition, dust or dirt enters through a gap between the central conductor and the insulative housing to contaminate the terminals, causing a malfunction. The terminals are attached to the insulative housing from the mounting side so that they are susceptible to a force from above or side to cause a malfunction. Since the central conductor is always in contact with the spring section of a terminal, it is difficult to improve the electrical characteristics.

SUMMARY OF THE INVENTION

Accordingly, it is an object of the invention to provide a switch-equipped coaxial connector capable of preventing contamination of the terminals and securing the terminals to the insulative housing to improve the reliability and electrical characteristics of the switch mechanism.

According to the invention there is provided a switch-equipped coaxial connector to be mounted on a board, which comprises an insulative housing having a hollow section and a bottom plate between the board and the hollow section; a fixed terminal attached to the insulative housing from side and having a contact section provided in the hollow section and a leg section adapted to be mounted on the board; a movable terminal attached to the insulative housing from side and having a movable section biased upwardly for contact with the contact section of the fixed terminal and a leg section adapted to be mounted on the board; a central conductor for sliding in an axial direction of the insulative housing; a spring member provided on the insulative housing to support the central conductor; and an outer conductor provided outside the spring member and the insulative housing such that when the central conductor is depressed, the movable section of the movable terminal is separated from the contact section of the fixed terminal.

It is preferred that the insulative housing has a side opening that the outer conductor is able to close, the fixed and movable terminals are secured to the insulative housing at a plurality of locations, and that the contact section of the fixed terminal is secured to the insulative housing.

According to another aspect of the invention there is provided a switch-equipped coaxial connector to be mounted on a board, which comprises an insulative housing having a hollow section; a fixed terminal attached to the insulative housing and having a contact section provided in the hollow section and a leg section adapted to be mounted on the board; a movable terminal attached to the housing and having a movable section biased upwardly in the hollow section for contact with the contact section and a leg section adapted to be mounted on the board; a central conductor for sliding in an axial direction of the insulative housing; a spring member having an inner edge for supporting a top end of the central conductor, an outer edge provided on the insulative housing, and a spring section provided between the inner and outer edges; and an outer conductor provided outside the spring member and the insulative housing to press the outer edge of the spring member so that an upper surface of the spring section is stretched and the central conductor is spaced from the movable section of the movable terminal, keeping the movable section and the contact section of the fixed terminal contact.

It is preferred that the outer edge of the spring member has an upward ridge and the outer conductor has a guiding section extending inwardly and downwardly from a top edge of the outer conductor so as to abut on an inner face of the upward ridge and that the central conductor has a narrow neck portion at its upper portion with which the inner edge of the spring member makes close contact, the inner edge being made thicker than the spring section.

Since the bottom plate separates the hollow section in which the switch mechanism, such as the terminal, is provided and the board on which the coaxial connector is mounted, it is possible to prevent contamination of the terminals and malfunction of the switch mechanism, thus improving the operational reliability.

DESCRIPTION OF THE PREFERRED EMBODIMENT

Figure 1:
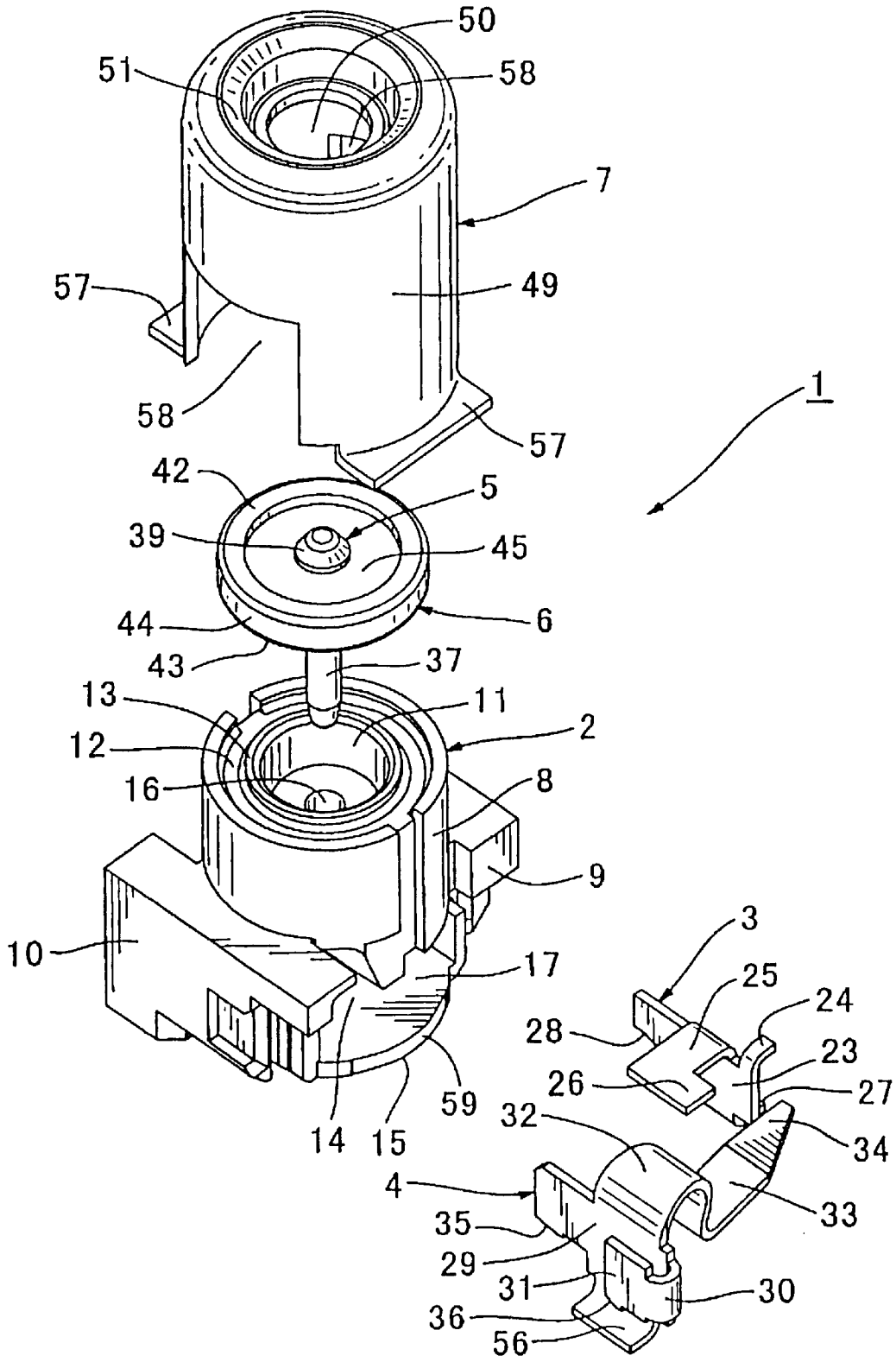
FIG. 1 is an exploded perspective view of a switch-equipped coaxial connector according to an embodiment of the invention.

Embodiments of the invention will now be described with reference to the accompanying drawings.

A switch-equipped coaxial connector 1 comprises a substantially cylindrical insulative housing 2, a fixed terminal 3, a movable terminal 4, a substantially rod-like central conductor 5, a substantially circular spring member 6, and a substantially cylindrical outer conductor 7. It is to be mounted on a board (not shown).

Figure 2:
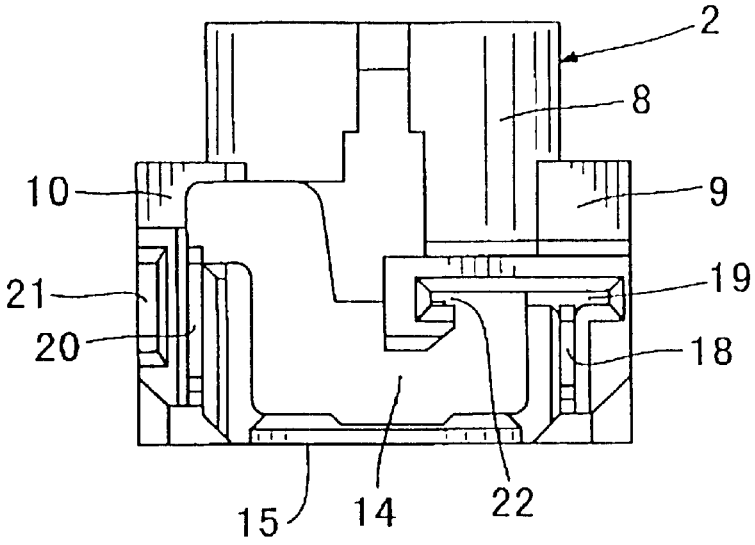
FIG. 2 is a side view of the switch-equipped coaxial connector.
Figure 3:
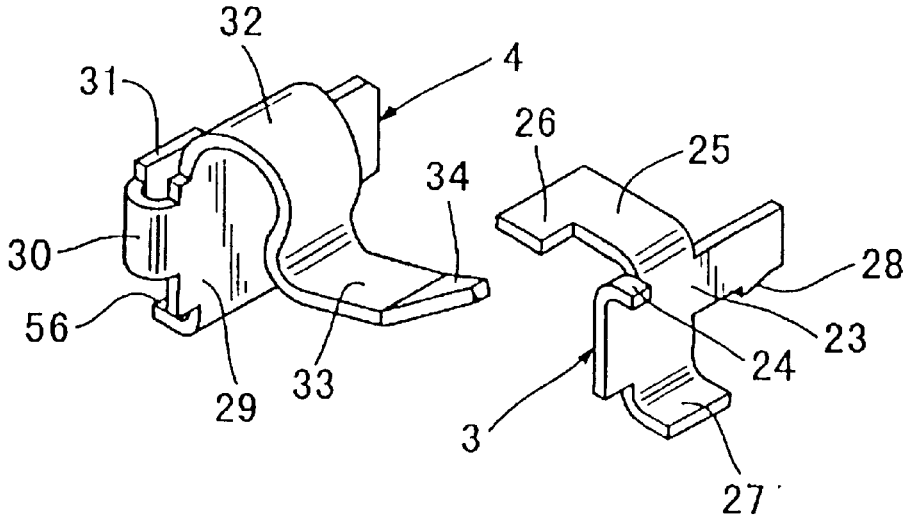
FIG. 3 is a perspective view of terminals for the switch-equipped coaxial connector.

The insulative housing 2 has a substantially cylindrical body member 8 and right and left extended sections 9 and 10 provided on the lower side of the body member 8. An indented portion 11 is provided in the top of the body member 8 and an annular groove 12 is provided around the indented portion 11 to form an annular ridge 13 between them. A hollow section 14 is provided in the lower part of the body member 8 to form a bottom plate 15 between the board and the hollow section 14. The bottom plate 15 has a curved side face 59 extending along the circumference of the body member 8. A communication hole 16 extends in the axial direction between the indented portion 11 and the hollow section 14. An opening portion 17 is provided in the side wall of the insulative housing 2 to communicate with the hollow section 14. As best shown in FIG. 2, the right and left extended sections 9 and 10 have right vertical and horizontal slots 18 and 19, and a left vertical slot 20, respectively. A cut-out portion 21 extends along the left vertical slot 20 and a short horizontal slot 22 is provided at the same level as the right horizontal slot 19.

The fixed and movable terminals 3 and 4 are press-fitted to the insulative housing 2 from side. The fixed terminal 3 has a first fixing section 23 to be press-fitted into the right vertical slot 18, a second fixing section 24 extending outwardly from the top edge of the fist fixing section 23 to be press-fitted into the right horizontal slot 19, a contact plate 25 extending inwardly from the top edge of the first fixing section 23, a third fixing section 26 extending laterally from the contact plate 25 to be press-fitted into the short horizontal slot 22, and a leg portion 27 extending outwardly from the lower end of the first fixing section 23 to be exposed beside the bottom plate 15 of the insulative housing 2 for connection with a circuit trace of the board. A wedge-shaped engaging section 28 extends downwardly from the lower edge of the first fixing section 23 to keep the first fixing section 23 in the right vertical slot 18.

The movable terminal 4 has a first fixing section 29 to be press-fitted into the left vertical slot 20, a second fixing section 31 connected to the first fixing section 29 via a curved arm section 30 and fitted into the cut-out section 21, a movable section 33 connected to the first fixing section 29 via a spring section 32, and a leg section 56 projecting from the bottom plate 15 of the insulative housing 2 and adapted to be connected to a circuit trace (not shown) of the board. The front end 34 of the movable section 33 extends slightly upwardly for contact with the contact section 25 of the fixed terminal 3, and the movable section 33 is biased by the spring section 32 to keep the contact of the front end 34. First and second engaging wedges 35 and 36 extend downwardly from the first and second fixing sections 29 and 31 to keep the first and second fixing sections 29 and 31 press-fitted.

The central conductor 5 has a rod section 37 for sliding along the communication aperture 16, a flange section 38 attached to the rod section 37 and having a diameter greater than the diameter of the communication aperture 16, a head section 39 provided at the top, and a neck section 40 provided between the head section 39 and the flange section 38.

The spring member 6 is attached to the insulative housing 2 in an airtight manner and provided with a small aperture 41 through which the central conductor 5 is passed. It has an outer edge 44 with upper and lower ridges 42 and 43, a circular spring plate 45, and an inner edge 46 that has a thickness greater than the thickness of the spring plate 45 and is fitted over the neck section 40 in an airtight manner. The lower ridge 43 of the outer edge 46 is fitted in the annular groove 12 such that the annular ridge 13 is brought into close contact with the lower face 47 of the spring plate 45 to form a gap 48 between the lower ridge 43 and the annular groove 12. Consequently, the lower face 47 of the spring plate 45 serves as standards for assembling the respective parts and improving the product precision.

The outer conductor 7, which is put over the spring member 6 and the insulative housing 2, has a circumference wall 49, a guide section 51 extends downwardly from the upper edge of the circumference wall 49 to a central circular hole 50, and a pair of opposed leg sections 57 extend downwardly from the circumference wall 49 to be connected to a ground circuit trace (not shown) of the board. A pair of cut-outs 58 are provided in the circumference wall 49 corresponding to the right and left extended sections 9 and 10 and the opening 17 is closed by the circumferential wall 49. The guide section 51 abuts on the inner side of the annular ridge 42 to hold the spring member 6 in an airtight manner while the head section 39 of the central conductor 5 is exposed in the circular hole 50.

The operation of the switch-equipped coaxial connector 1 will be described with reference to FIGS. 4 and 5, wherein a plug 52 with a convex tip comprises a central conductor 53, an outer conductor 54, and an insulation member 55 between them.

Figure 4:
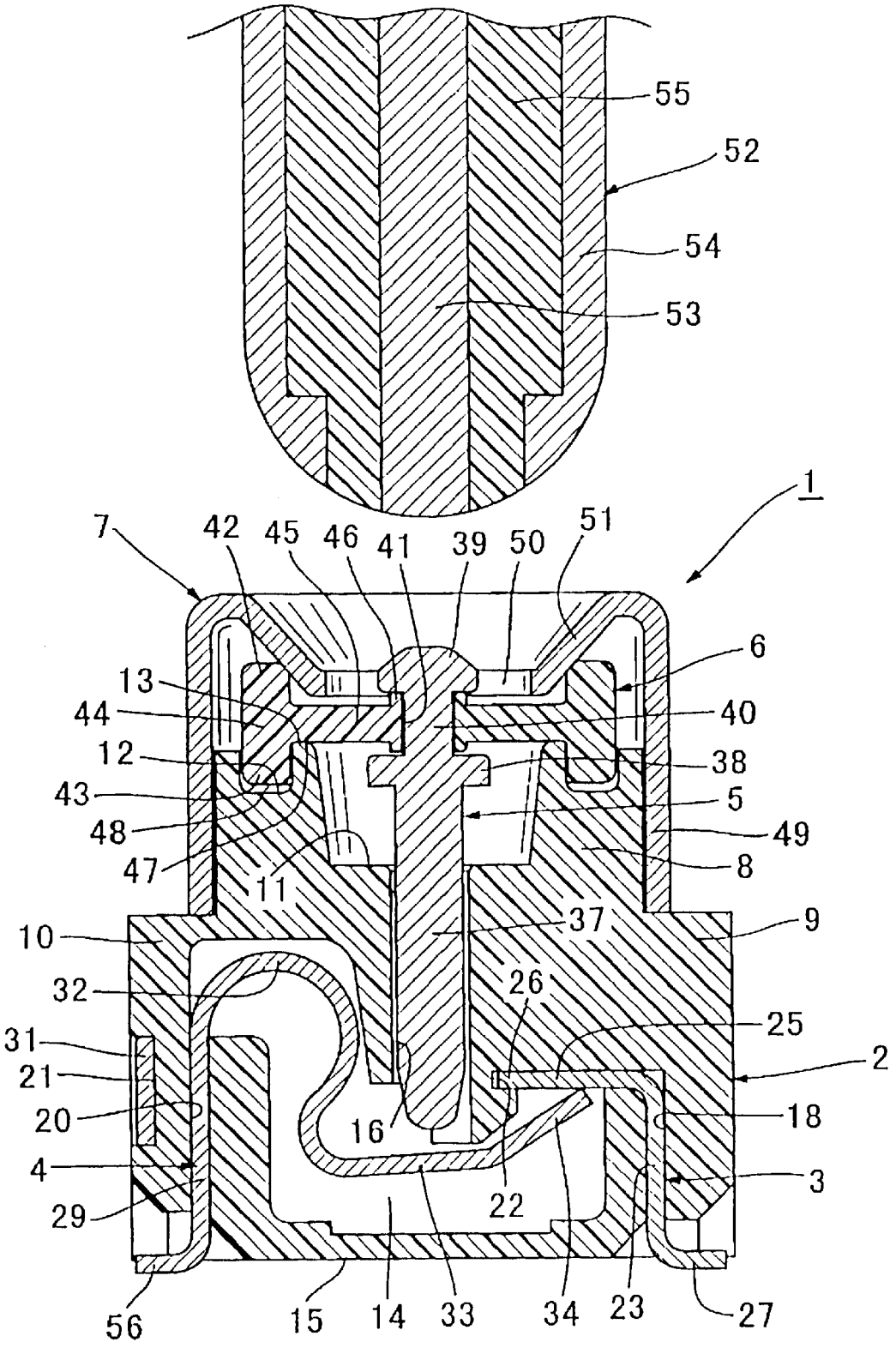
FIG. 4 is a sectional view of the switch-equipped coaxial connector when the inner antenna is used.

In FIG. 4, when the inner antenna of a mobile phone is used or the plug 52 is separated from the switch-equipped coaxial connector 1, the upper ridge 42 of the spring member 6 is pressed outwardly by the guide section 51 to stretch the upper surface of the spring plate 45 so that the central conductor 5 is supported by the spring member 6 with lower end spaced by a predetermined distance from the movable section 33. At this point, the front end 34 of the movable terminal 4 is kept contact with the contact section 25 of the fixed terminal 3 by the spring section 32. Since the spring plate 45 is kept stretched by the guide member 51, even if vibrations are applied to it, the central conductor 5 does not move up and down so that the distance between the central conductor 5 and the movable section 33 is kept within a predetermined range, improving the reliability of the switch mechanism.

Figure 5:
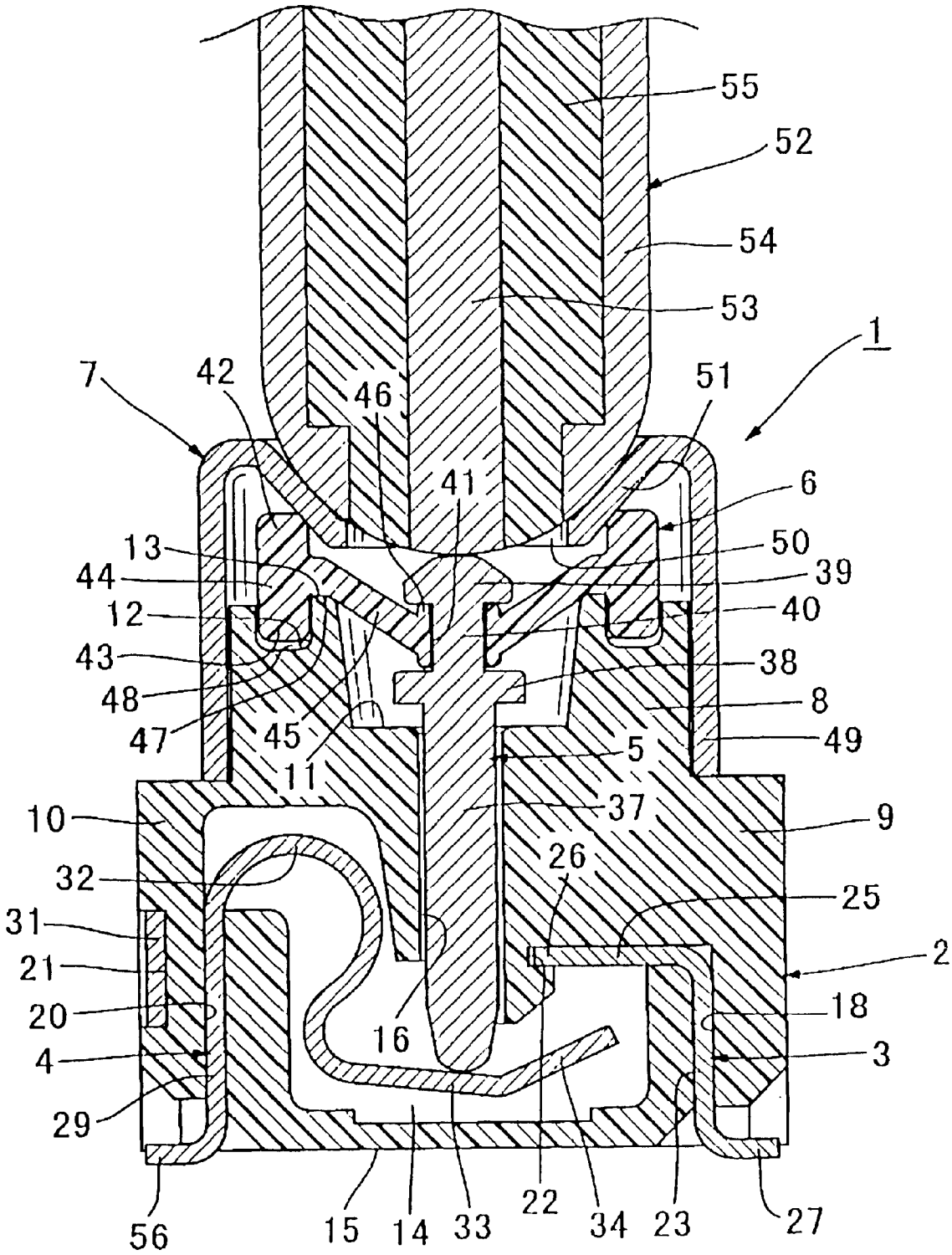
FIG. 5 is a section view of the switch-equipped coaxial connector when an outer antenna is used.

In FIG. 5, when the outer antenna is used, the plug 52 is pressed against the switch-equipped coaxial connector 1. Since the guide section 51 is sloped inwardly and the plug 52 has a convex tip, it is easy and certain that the central and outer conductors 53 and 55 of the plug 52 are brought into contact with the central and outer conductors 5 and 7, respectively, of the coaxial connector 1. The central conductor 5 is pressed downwardly by the plug 52 along the communication aperture 16 to flex downwardly the spring plate 45 so that it abuts on and bring the movable section 33 downwardly. Consequently, the front end 34 of the movable section 33 is separated from the contact section 25 of the fixed terminal 3 so that the plug 52 is electrically connected to the predetermined circuit (not shown) of the board via the coaxial connector 1.

Since the first and second fixing sections 29 and 31 are secured to the insulative housing 2 by the first and second engaging portions 35 and 36, respectively, the movable terminal 4 does not fall or shift under the pressure of the central conductor 5. Since the third fixing section 26 is secured to the small horizontal groove 22, the fixed terminal 3 does not move in step of the movement of the movable terminal 4, assuring the stable switching operation. The inner edge 46 is thicker than the spring plate 45 so that the spring plate 45 does not make contact with the flexed head section 39 and thus is kept from damage.

Since the annular ridge 13 of the insulative housing 2 and the lower face 47 of the spring member 6, the guide section 51 of the outer conductor 7 and the upper ridge 42 of the spring member 6, and the inner ridge 46 of the spring member 6 and the head section 40 of the central conductor 5 are in close contact with each other, neither dust nor dirt enters the hollow section 14 and it is suitable for transportation by a vacuum machine. Since the opening section 17 of the insulative housing 2 is closed by the outer conductor 7, neither dust nor dirt enters the hollow section 14 from side and, since the insulative housing 2 has the bottom plate 15, when the switch-equipped coaxial connector 1 is soldered to the board, the generated gas or flux does not enter the hollow section 14. Consequently, there is no danger that dust or dirt contaminates the fixed and/or movable terminal 3 or 4, causing a malfunction of the switch mechanism. The switch-equipped coaxial connector according to the invention may also be useful for testing equipment.

Alternatively, the outer conductor 54 of a plug may be made to cover the outer conductor 7 of the coaxial connector so as to maintain the engagement with the guide section 51 independently. Since the outer conductor 54 of the plug abuts on the right and left extended sections 9 and 10, the fitting length of the plug is regulated. The shapes of the insulative housing 2, the fixed and movable terminals 3 and 4, the central and outer conductors 5 and 7, and the spring member 6 may vary as far as they function in a way equivalent to the above-mentioned components.

As has been described above, according to the invention, the bottom plate separates the hollow section in which the switch mechanism, such as terminals, is provided from the board on which the coaxial connector is mounted so that neither flux nor gas generated upon soldering the coaxial connector to a board enters the hollow section from below. Since the spring member and the outer conductor close the hollow section, neither dust nor dirt enters the hollow section from above or side so that it is possible to prevent contamination of the terminals and malfunction of the switch mechanism, resulting in the improved reliability.

The terminals are attached at a plurality of locations to the insulative housing in the direction perpendicular to the operational direction of the switch mechanism so that they are strong against forces in the operational direction of the switch mechanism and twisting direction and able to maintain the contact pressure at the predetermined level, assuring the reliable switching operation. Since the terminal is attached to the insulative housing from side, it is possible to simplify the assembling and save the labor. The central conductor makes contact with the terminal only when it is necessary so that it is easy to improve the electrical characteristics of the switch mechanism.

I claim:

1. A switch-equipped coaxial connector to be mounted on a board, comprising:

an insulative housing having a hollow section, vertical slots, and a bottom plate between said board and said hollow section;

a fixed terminal attached to one side of said vertical slots of said insulative housing and having a contact section provided in said hollow section and a leg section adapted to mount on said board;

a movable terminal attached to the other side of said vertical slots of said insulative housing and having a movable section biased upwardly for contact with said contact section of said fixed terminal and a leg section adapted to mount on said board;

a central conductor for sliding in an axial direction of said insulative housing;

a spring member attached on a top edge of said insulative housing to support said central conductor so that said central conductor is spaced from said movable section of said movable terminal; and an outer conductor with central hole and a guiding section enclosed outside said spring member and said insulative housing such that when said central conductor is depressed by a plug which being inserted into the guiding section, the plug pressing said spring member downwardly, said movable section of said movable terminal is separated from said contact section of said fixed terminal.

2. The switch-equipped coaxial connector according to claim 1, wherein said insulative housing has a side opening that said outer conductor is able to close.

3. The switch-equipped coaxial connector according to claim 1 or 2, wherein said fixed and movable terminals are secured to said insulative housing at a plurality of locations.

4. The switch-equipped coaxial connector according to claim 3, wherein said contact section of said fixed terminal is secured to said insulative housing.

5. A switch-equipped coaxial connector to be mounted on a board, comprising:

an insulative housing having a hollow section and vertical slots;

fixed terminal attached in one side of said slots of said insulative housing and having a contact section provided in said hollow section and a leg section adapted to mount on said board;

movable terminal attached in the other side of said slots of said housing and having a movable section biased upwardly in said hollow section for contact with said contact section and a leg section adapted to mount on said board;

a central conductor for sliding in an axial direction of said insulative housing;

a spring member attached on a top edge of said insulative housing, said spring member having an inner edge for supporting a top end of said central conductor, an outer edge supported by said insulative housing, and a spring section provided between said inner and outer edges; and an outer conductor with a central hole and a guiding section enclosed outside said spring member and said insulative housing, wherein when said central conductor is not pressed by a plug which is being inserted into the guiding section, said central conductor is spaced from movable section of said movable terminal and said movable section and said contact section keep contact with each other, and when said central conductor is pressed by said plug to flex said spring section of said spring member downwardly, said central conductor abuts on said movable section to separate said movable section from said contact section.

6. The switch-equipped coaxial connector according to claim 5, wherein said outer edge of said spring member has an upward ridge and said outer conductor has a guiding section extending inwardly and downwardly from a top edge of said outer conductor so as to abut on an inner face of said upward ridge.

7. The switch-equipped coaxial connector according to claim 6 or 5, wherein said central conductor has a narrow neck portion at an upper portion thereof over which said inner edge of said spring member is fitted in airtight manner, said inner edge being made thicker than said spring section.

* * * * *